US010455913B1

(12) United States Patent
Tan

(10) Patent No.: US 10,455,913 B1
(45) Date of Patent: Oct. 29, 2019

(54) LUGGAGE WITH AUTO-SUPPORT MECHANISM

(71) Applicant: Fu-Hsing Tan, Taoyuan Hsien (TW)

(72) Inventor: Fu-Hsing Tan, Taoyuan Hsien (TW)

( * ) Notice: Subject to any disclaimer, the term of this patent is extended or adjusted under 35 U.S.C. 154(b) by 23 days.

(21) Appl. No.: 15/947,859

(22) Filed: Apr. 8, 2018

(51) Int. Cl.
*A45C 5/14* (2006.01)

(52) U.S. Cl.
CPC ..... *A45C 5/145* (2013.01); *A45C 2005/148* (2013.01)

(58) Field of Classification Search
CPC ..... A45C 5/145; A45C 2005/148
See application file for complete search history.

(56) References Cited

U.S. PATENT DOCUMENTS 475,977 A * 5/1892 Dillingham ..... A45C 5/14 190/18 R
619,896 A * 2/1899 Lee ..... F16B 33/004 174/138 R
1,092,506 A * 4/1914 Oldroyd ..... B60B 33/06 16/34
2,033,207 A * 3/1936 Schultz, Jr. ..... B60B 33/0078 16/32
2,698,454 A * 1/1955 Meyer ..... B60B 33/06 16/31 R
3,537,721 A * 11/1970 Warner, Jr. ..... A45C 5/14 16/18 R
3,719,370 A * 3/1973 Gintick ..... B62B 5/0423 280/33.994
6,382,736 B1 * 5/2002 Chang ..... A45C 5/14 16/44
8,844,950 B2 * 9/2014 Greene ..... B25H 1/04 280/30
8,936,257 B2 * 1/2015 Kinnee ..... A45C 5/146 16/44

* cited by examiner

*Primary Examiner* — Tri M Mai

(57) ABSTRACT

A luggage includes a luggage body, a luggage wheel mounted to each of two opposite lateral sides of the luggage body, and a support mechanism mounted to the luggage body. The support mechanism includes a locating shaft affixed to the luggage body, and a support member pivotally coupled to the locating shaft with a support portion and an actuation portion respectively located on two opposite ends thereof such that when the luggage body is shifted from a tilted position to an erected position, the actuation portion is forced by the floor to bias the support member and to further force the support portion into abutment against the floor where the distance between the support portion and the front side of the luggage body is larger than the distance between the axis of the luggage wheels and the front side of the luggage body to prevent falling of the luggage.

4 Claims, 10 Drawing Sheets

LUGGAGE WITH AUTO-SUPPORT MECHANISM

BACKGROUND OF THE INVENTION

1. Field of the Invention

The present invention relates to luggage technology and more particularly, to a luggage with auto-support mechanism, which automatically increases the supporting distance between the front and back sides of the luggage body when the luggage body is held in an erected position, preventing the luggage body from falling down.

2. Description of the Related Art

At the bottom of the luggage, wheels are installed so that the luggage can be easily pushed or pulled by the user. At the present, most luggage wheels are small diameter wheels to avoid increasing the overall size of the luggage. However, when moving on an uneven road surface (such as cracked or gravel ground), small diameter wheels can get stuck. Further, when carrying a luggage up or down stairs, the user needs to lift the luggage from stairs and to move the luggage by hand.

When a luggage is equipped with large diameter wheels, the luggage can be conveniently moved on an uneven road surface or stairs, however, the overall size of the luggage will increase, and the support point will be close to the inner side of the luggage body, making the luggage easy to fall down.

SUMMARY OF THE INVENTION

The present invention has been accomplished under the circumstances in view. It is therefore the main object of the present invention to provide a luggage with auto-support mechanism, which automatically increases the supporting distance between the front and back sides of the luggage body when the luggage body is held in an erected position, preventing the luggage body from falling down.

To achieve this and other objects of the present invention, a luggage comprises a luggage body, a luggage wheel mounted to each of two opposite lateral sides of the luggage body, and a support mechanism mounted to each of the two opposite lateral sides of the luggage body corresponding to one respective luggage wheel. The support mechanism comprises a locating shaft, a support member and a position-limiting member. The locating shaft is affixed to the luggage body, comprising a first locating groove and a second locating groove located on the periphery thereof, and a stop rib disposed between the first locating groove and the second locating groove. The support member comprises a base block, a pivot hole located on the base block and pivotally coupled to the locating shaft, a support portion located on one end of the base block and an actuation portion located on an opposite end of the base block. The position-limiting member is mounted in the base block of the support member and transversely movable in and out of the pivot hole.

When the luggage body is tilted for movement by the luggage wheels, the position-limiting member is engaged in the second locating groove to lock the support member in a position where the actuation portion protrudes over a bottom side of the luggage body. When luggage body is shifted from the tilted position to an erected position, the actuation portion is forced by the floor to bias the support member, causing movement of the position-limiting member out of the second locating groove over the stop rib into the first positioning groove and simultaneously forcing the support portion into abutment against the floor where the distance between the support portion and a front side of the luggage body is larger than the distance between the axis of the luggage wheels and the front side of the luggage body.

DETAILED DESCRIPTION OF THE PREFERRED EMBODIMENT

Figure 1:
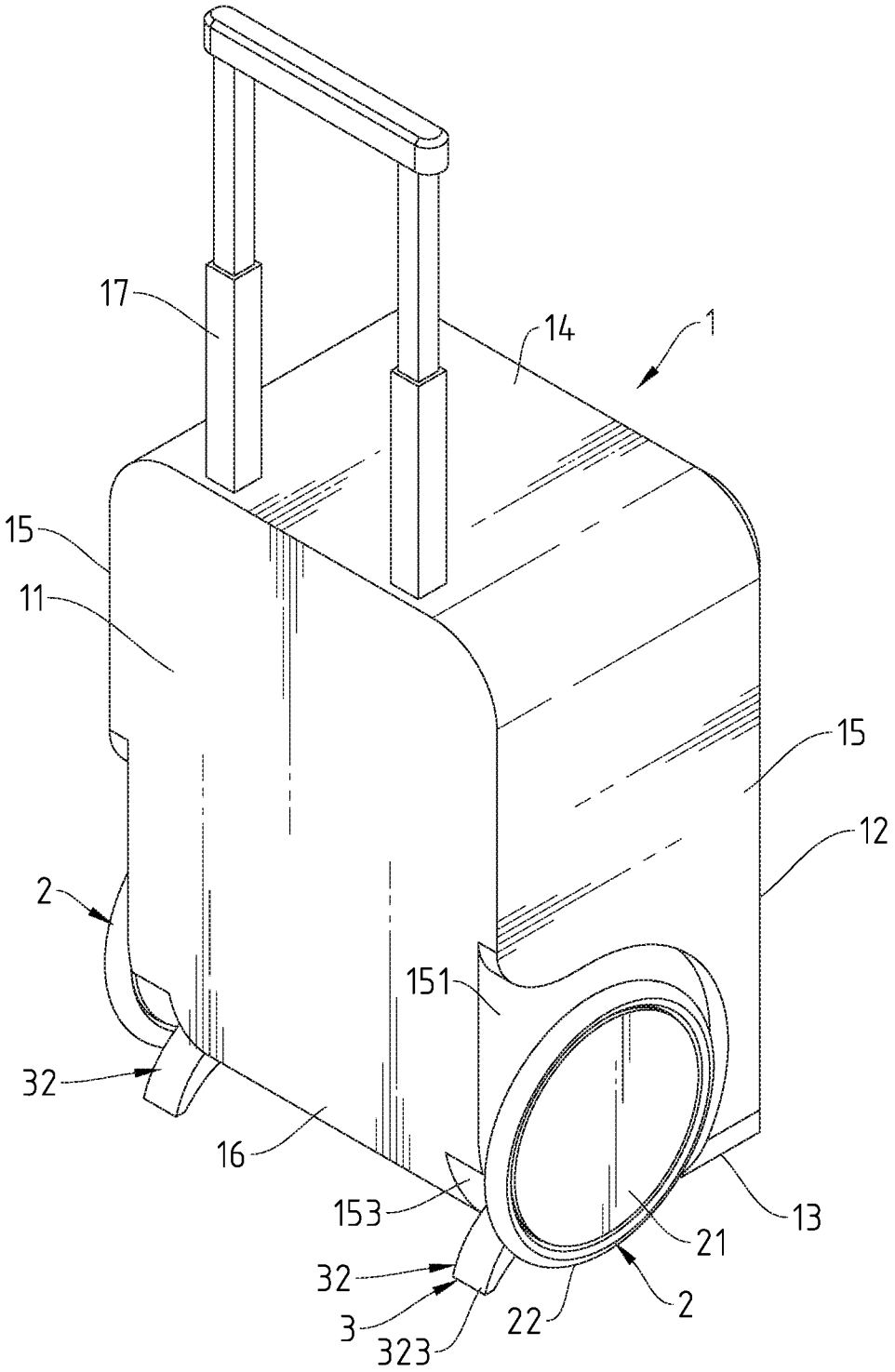
FIG. 1 is an oblique top elevation of a luggage with auto-support mechanism in accordance with the present invention.
Figure 2:
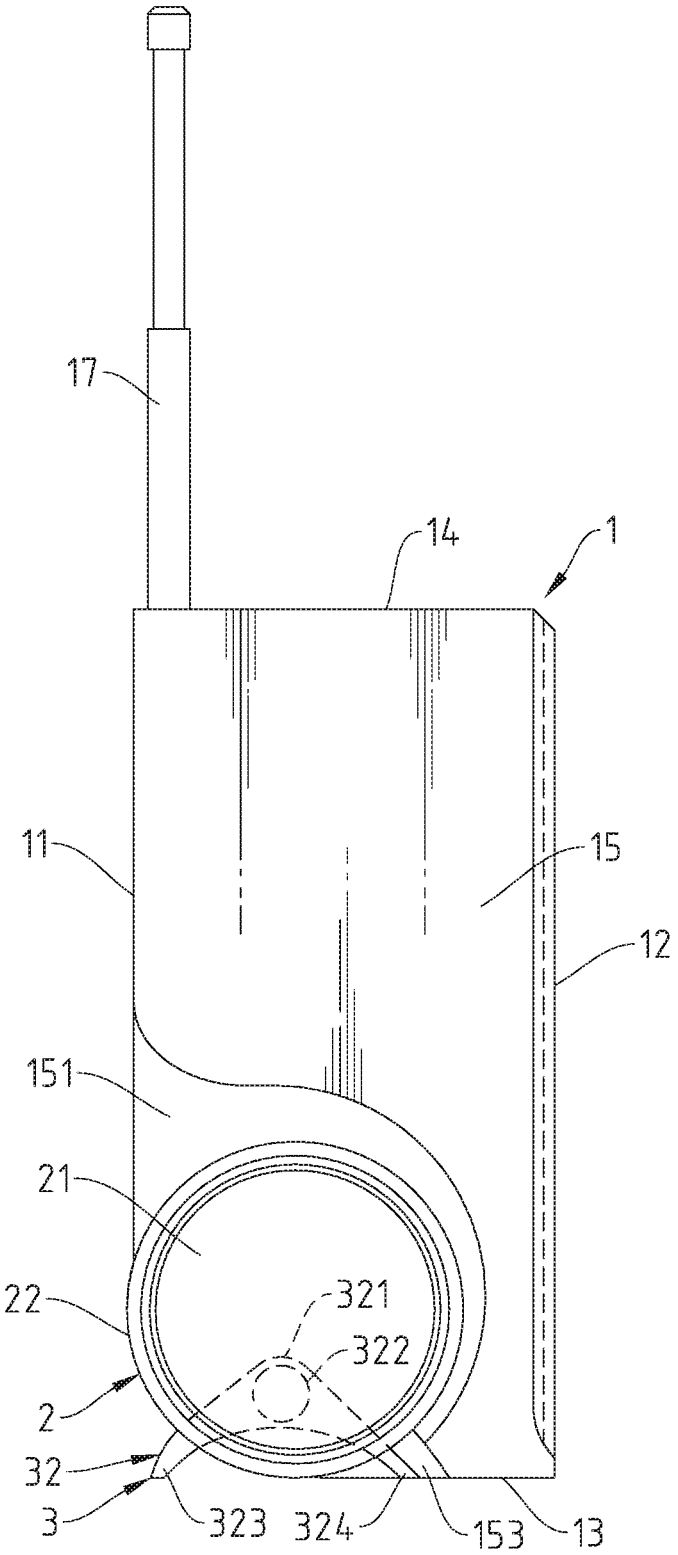
FIG. 2 is a schematic side view of the luggage with auto-support mechanism in accordance with the present invention.
Figure 3:
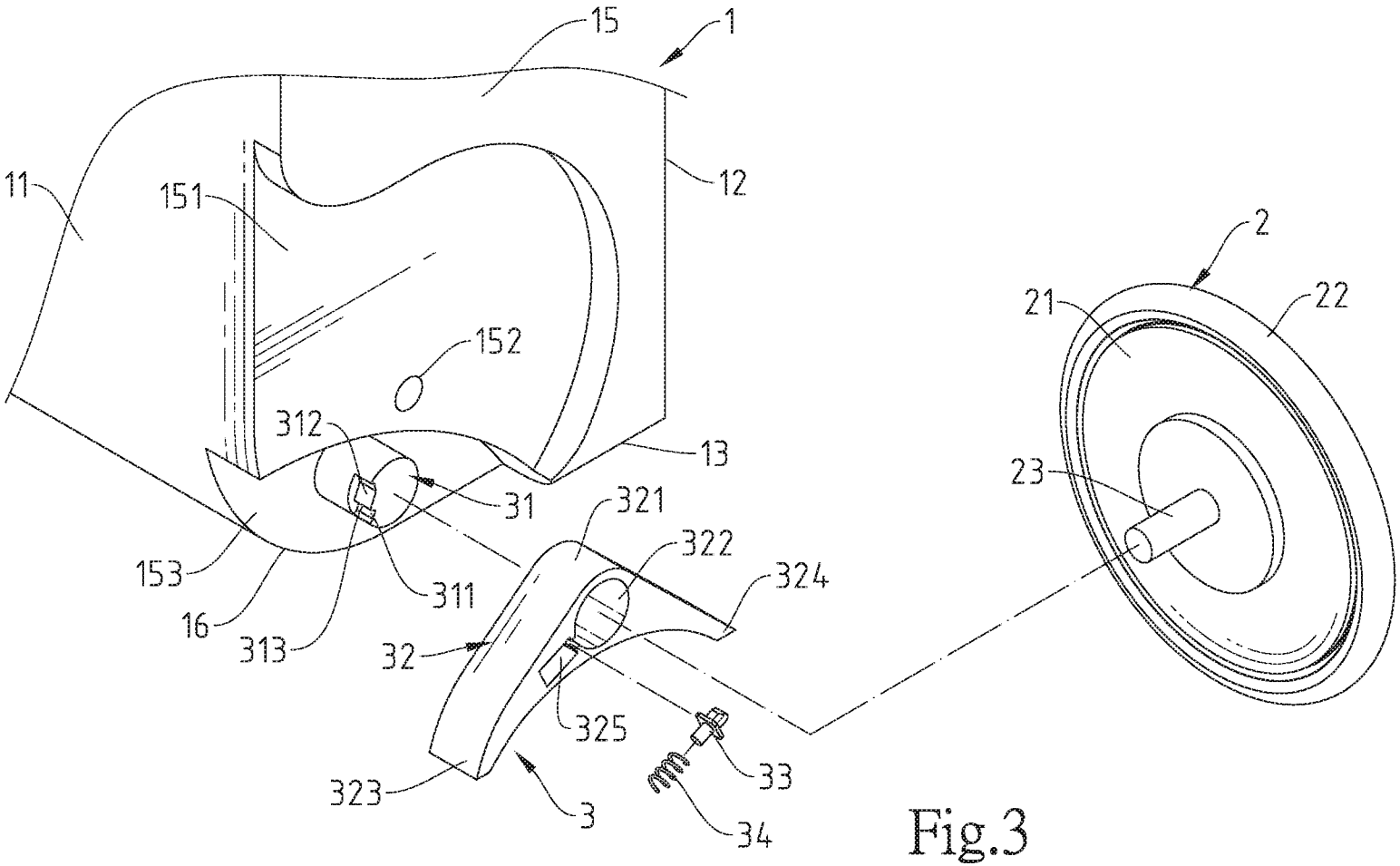
FIG. 3 is an exploded view of a part of the luggage with auto-support mechanism in accordance with the present invention.
Figure 4:
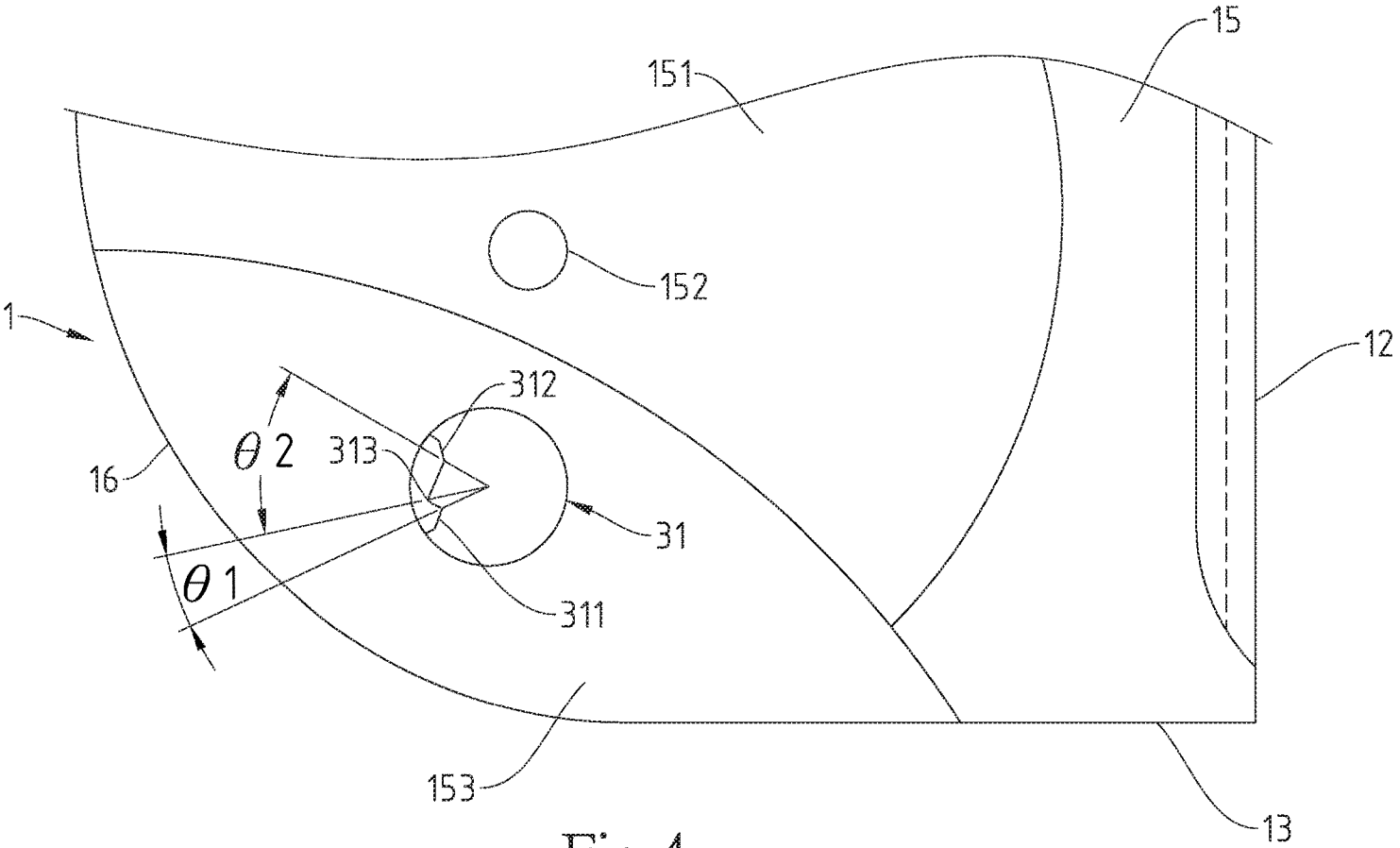
FIG. 4 is a schematic side view of a part of the present invention, illustrating the configuration of the locating shaft.

Referring to FIGS. 1-4, a luggage with auto-support mechanism in accordance with the present invention is shown. The luggage with auto-support mechanism comprises a luggage body 1, at least one, for example, two luggage wheels 2, and a support mechanism 3 corresponding to each luggage wheel 2.

The luggage body 1 consists of a back panel 11, a front panel 12, a bottom panel 13, a top panel 14 and two opposing side panels 15. Further, the luggage body 1 comprises a giving-away surface 16 located on the junction between the bottom panel 13 and the back panel 11 and inwardly recessed toward the inside of the luggage body 1, a retractable handle 17 mounted to the back panel 11, a first positioning groove 151 located on each side panel 15 between the back panel 11 and the bottom panel 13, a positioning hole 152 located in the first positioning groove 151, and a second positioning groove 153 located on each side panel 15 at a bottom side of the first positioning groove 151 near the giving-away surface 16. Further, in this embodiment, the giving-away surface 16 is circularly arched.

The luggage wheels 2 are respectively mounted to the side panels 15 of the luggage body 1, each comprising a wheel holder 21 and a tire 22 pivotally mounted on the wheel holder 21. The wheel holder 21 comprises a positioning shaft 23 perpendicularly extended from one side thereof and fastened to the positioning hole 152 on one respective side panel 15 of the luggage body 1, enabling the tire 22 to peripherally expose to the outside of the giving-away surface 16 of the luggage body 1 so that the luggage body 1 can be smoothly moved over an uneven road surface or stairs.

The support mechanism 3 comprises a locating shaft 31, a support member 32, a position-limiting member 33 and a spring member 34. The locating shaft 31 is fixedly mounted in the second positioning groove 153 on the respective side panel 15 of the luggage body 1, comprising a first locating groove 311 and a second locating groove 312 on the periphery thereof and a stop rib 313 between the first locating groove 311 and the second locating groove 312. The angle 01 defined between the first locating groove 311 and the stop rib 313 is smaller than the angle 02 defined between the second locating groove 312 and the stop rib 313. The support member 32 comprises a base block 321, a pivot hole 322 located on the base block 321 and pivotally coupled to the locating shaft 31, a support portion 323 located on one end of the base block 321, an actuation portion 324 located on an opposite end of the base block 321, and a slot 325 located on the base block 321 between the pivot hole 322 and the support portion 323 and disposed in communication with the pivot hole 322. The position-limiting member 33 is accommodated in the slot 325. The spring member 34 is mounted in the slot 325 and loaded on the position-limiting member 33 to impart a pressure to the position-limiting member 33, forcing the position-limiting member 33 toward the inside of the pivot hole 322.

Figure 5:
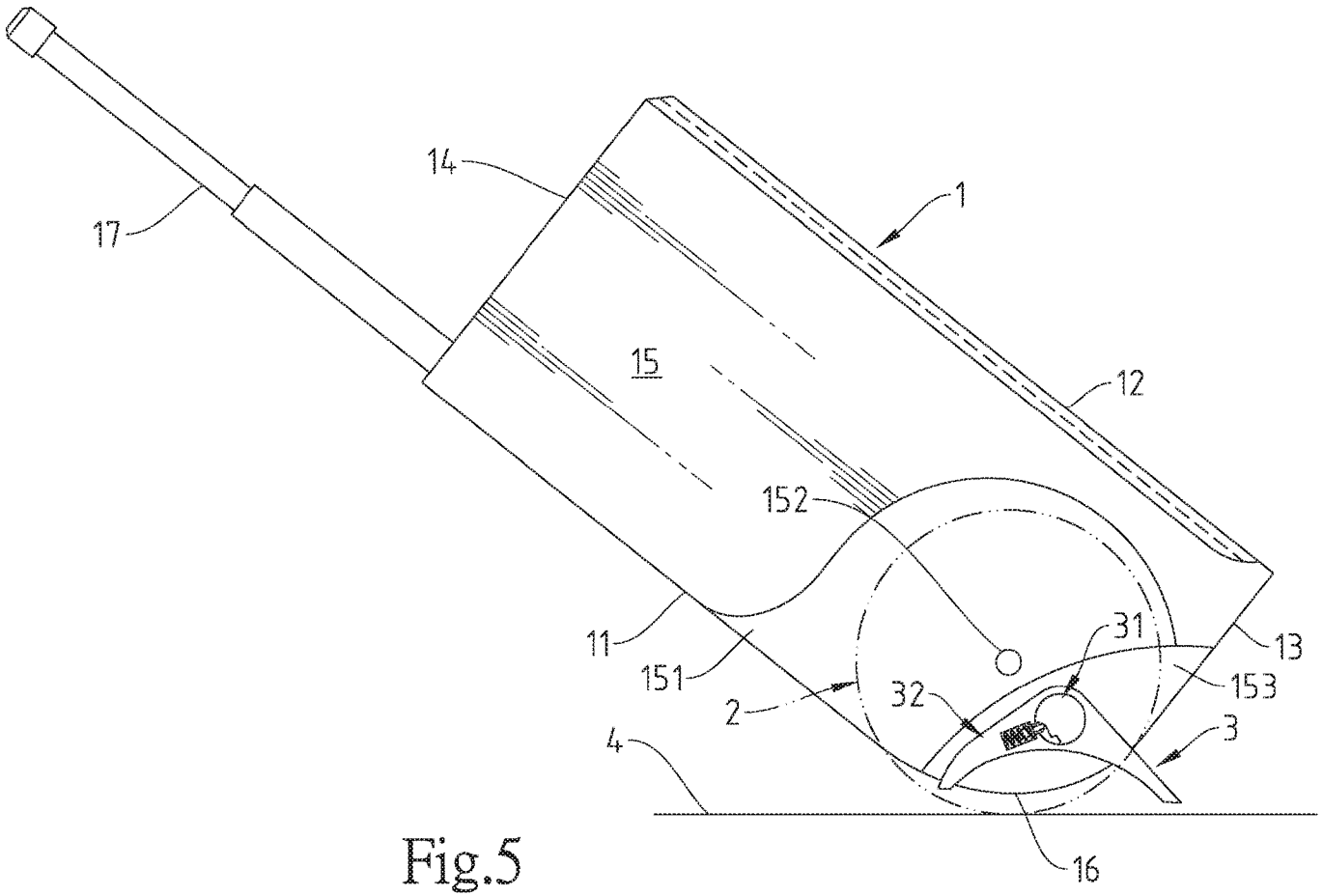
FIG. 5 is a schematic applied view of the present invention, illustrating the luggage body tilted and moved.
Figure 6:
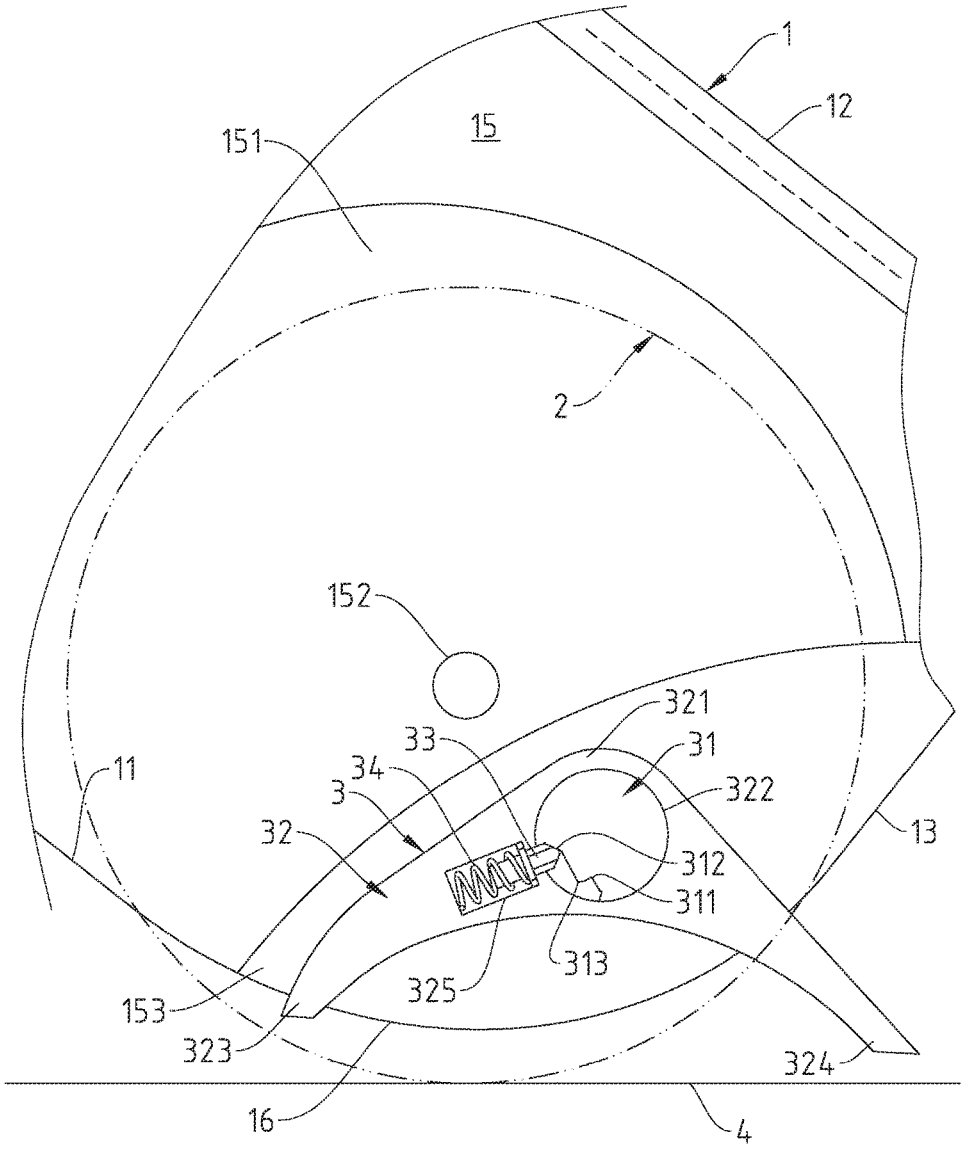
FIG. 6 is an enlarged view of a part of FIG. 5.
Figure 7:
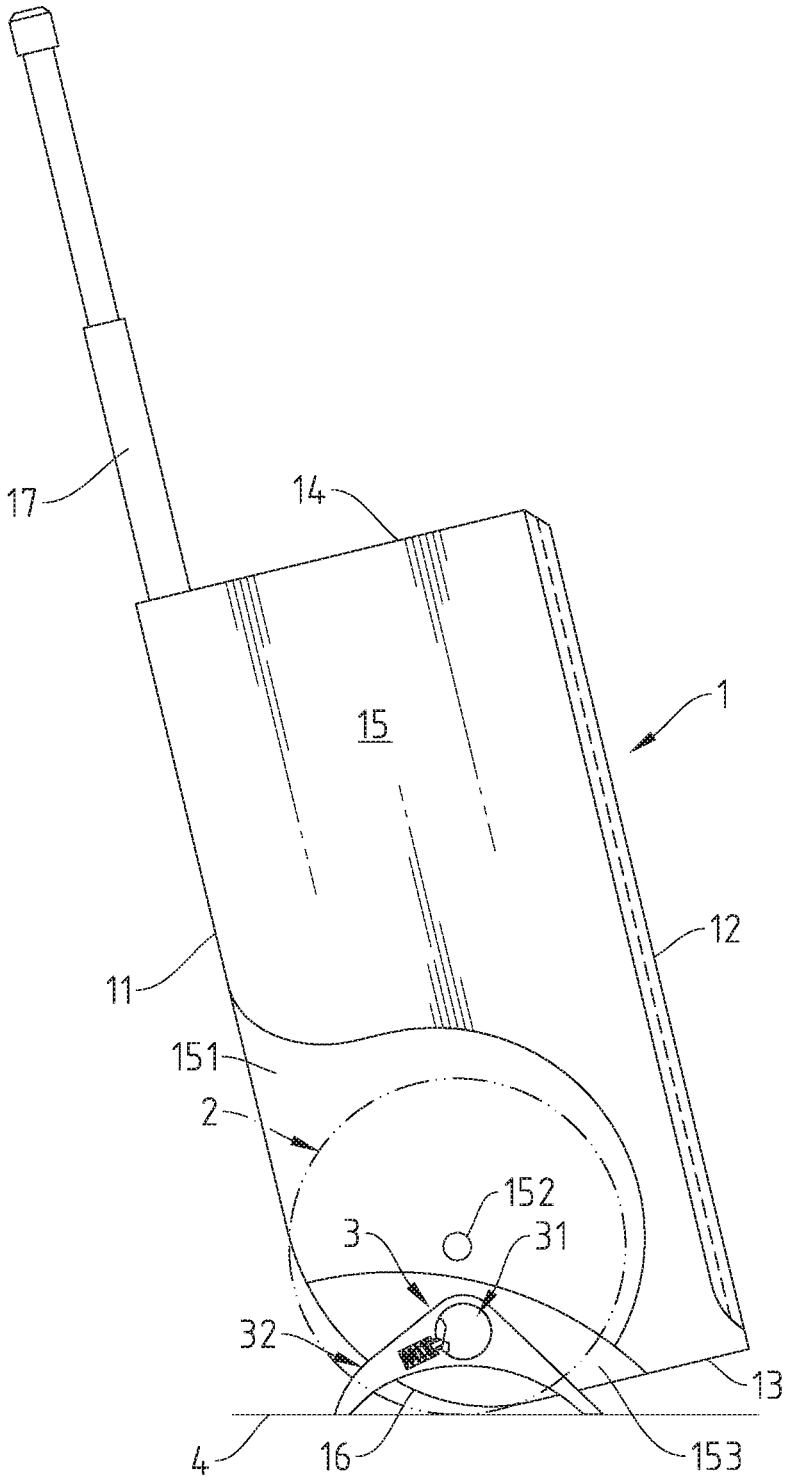
FIG. 7 is a schematic drawing illustrating the luggage body shifted from a tilted position toward the erected position.
Figure 8:
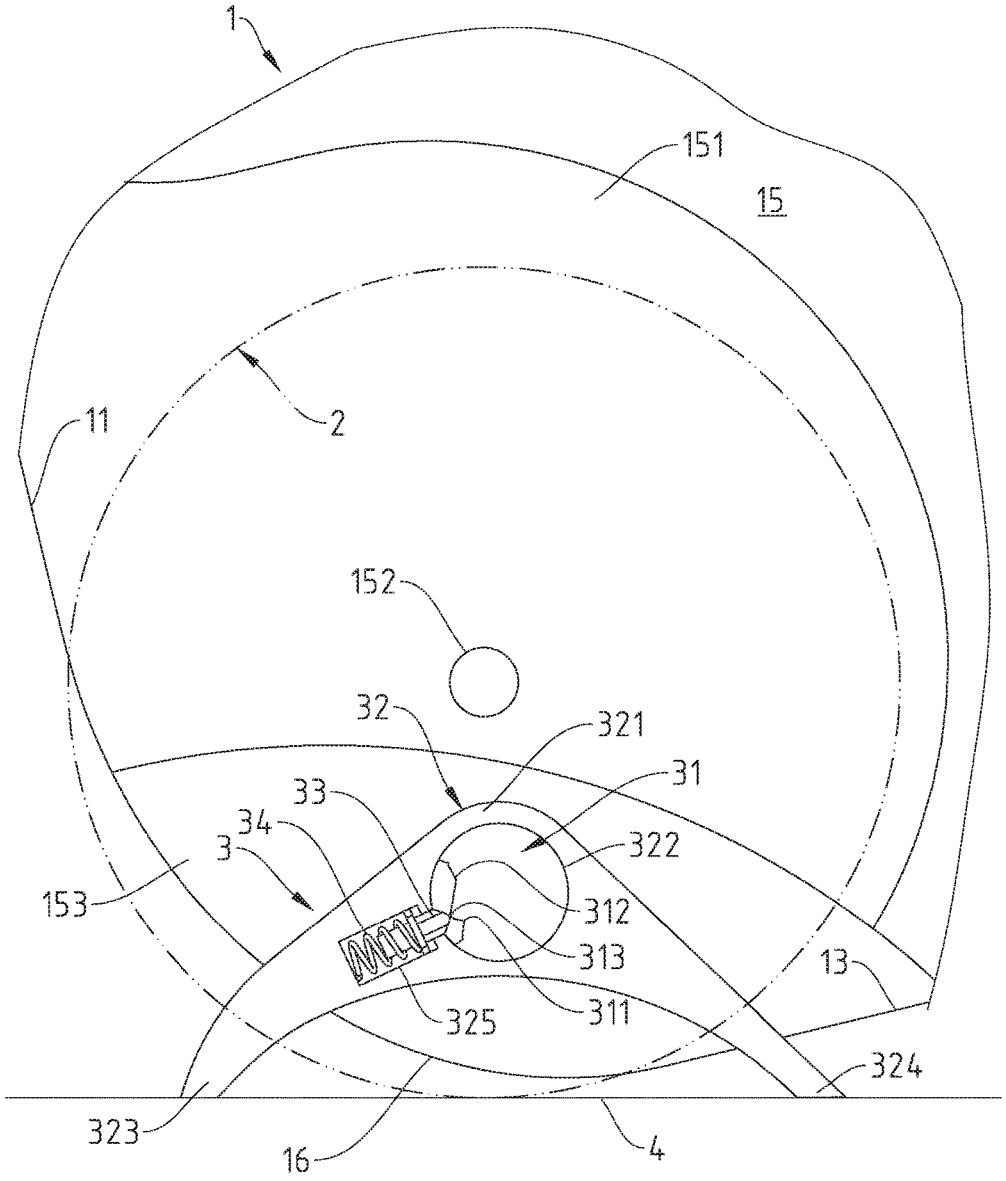
FIG. 8 is an enlarged view of a part of FIG. 7.
Figure 9:
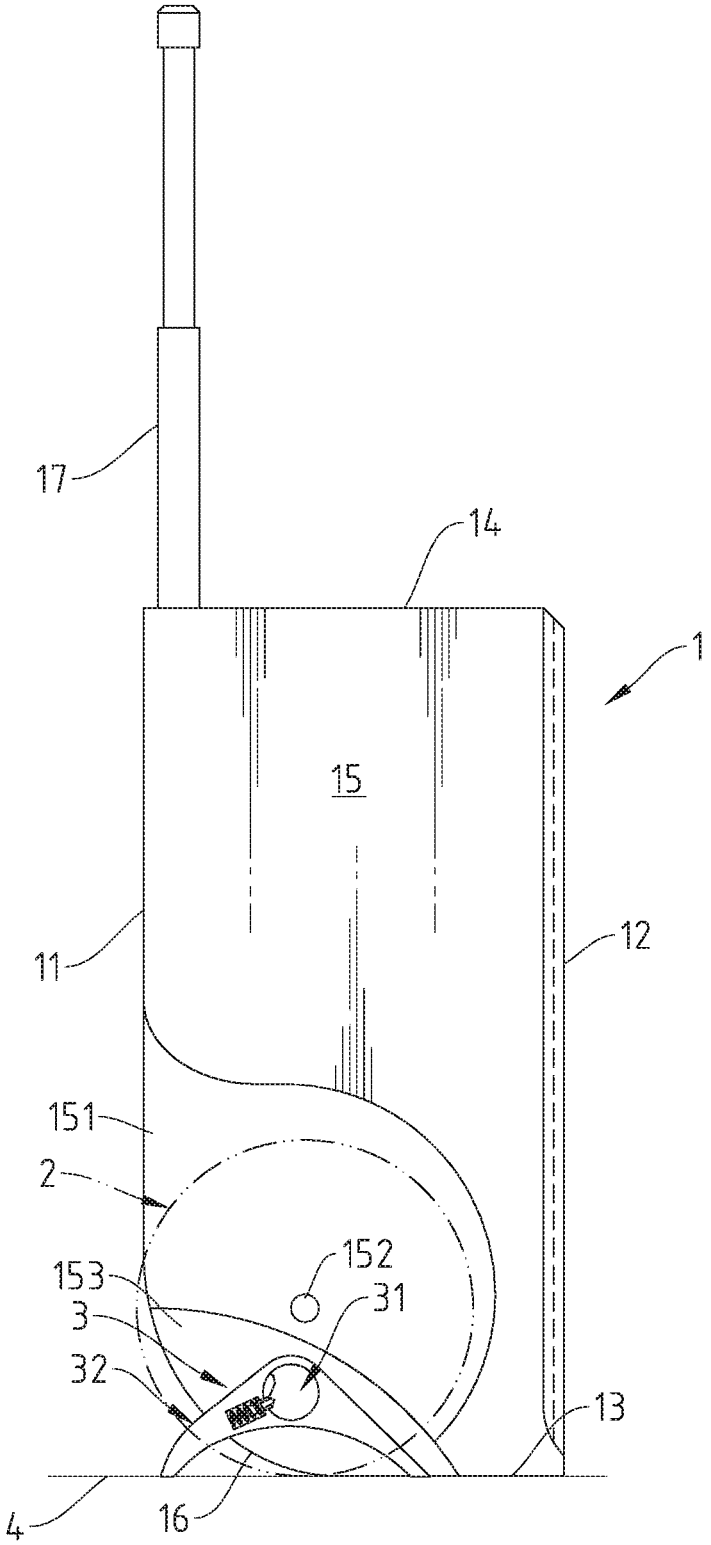
FIG. 9 is a schematic drawing illustrating the luggage body in the erected position.
Figure 10:
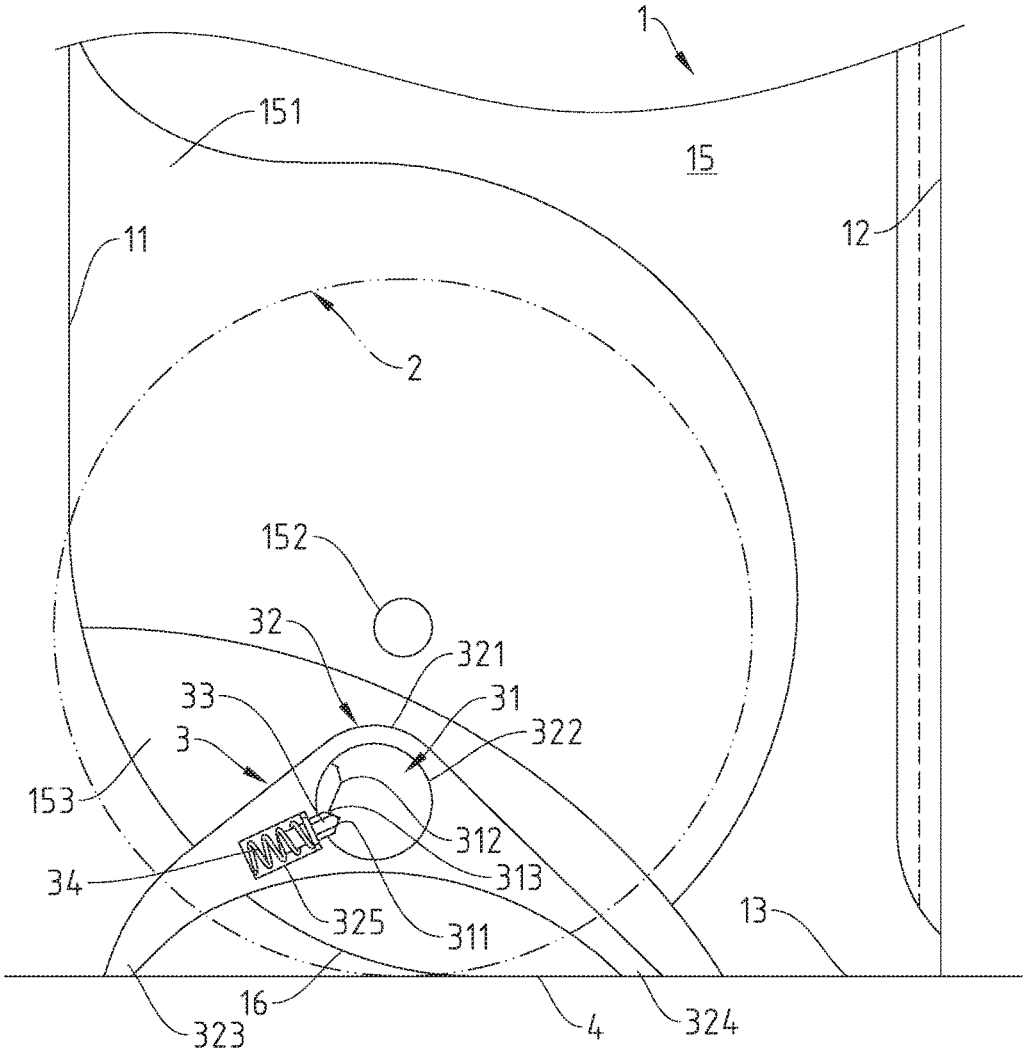
FIG. 10 is an enlarged view of a part of FIG. 9.

Please refer to FIGS. 4-10. As illustrated in FIGS. 5 and 6, when the luggage body 1 is tilted for movement by the luggage wheels 2, the position-limiting member 33 is engaged into the second locating groove 312 to lock the support member 32 in the position where the actuation portion 324 protrudes over the bottom panel 13 of the luggage body 1 and the support portion 323 and the actuation portion 324 respectively define with the bottom panel 13 a respective contained angle without interfering with the movement of the tilted luggage body 1. As illustrated in FIGS. 7-10, when the luggage body 1 in shifted from the tilted position to an erected position, the actuation portion 324 is forced by the floor 4 to bias the support member 32, causing movement of the position-limiting member 33 out of the second locating groove 312 over the stop rib 313 into the first positioning groove 311 and forcing the support portion 323 into abutment against the floor 4. At this time, the distance between the support portion 323 and the front panel 12 of the luggage body 1 is larger than the distance between the axis of the tire 22 of the luggage wheel 2 and the front panel 12 of the luggage body 1, and thus, the luggage body 1 is prohibited from falling down. Further, when the luggage body 1 is shifted from the erected position to a tilted position, due to the design that the angle defined between the first locating groove 311 and the stop rib 313 is smaller than the angle defined between the second locating groove 312 and the stop rib 313, the position-limiting member 33 is rapidly shifted from the first locating groove 311 to the second locating groove 312. Further, the stop rib 313 has two opposite lateral side beveled so that when the position-limiting member 33 is moved over the stop rib 313, it will automatically enter the first locating groove 311 or the second locating groove 312.

What the invention claimed is:

1. A luggage, comprising a luggage body, a luggage wheel mounted to each of two opposite lateral sides of said luggage body and a support mechanism mounted to each of the said two opposite lateral sides of said luggage body corresponding to one respective said luggage wheel, wherein:

said support mechanism comprises a locating shaft, a support member and a position-limiting member, said locating shaft being affixed to said luggage body and comprising a first locating groove and a second locating groove located on the periphery thereof and a stop rib disposed between said first locating groove and said second locating groove, said support member comprising a base block, a pivot hole located on said base block and pivotally coupled to said locating shaft, a support portion located on one end of said base block and an actuation portion located on an opposite end of said base block, said position-limiting member being mounted in said base block of said support member and transversely movable in and out of said pivot hole such that when said luggage body is tilted for movement by said luggage wheels, said position-limiting member is engaged in said second locating groove to lock said support member in a position where said actuation portion protrudes over a bottom side of said luggage body; when said luggage body is shifted from said tilted position to an erected position, said actuation portion is forced by the floor to bias said support member, causing movement of said position-limiting member out of said second locating groove over said stop rib into said first positioning groove and simultaneously forcing said support portion into abutment against the floor where the distance between said support portion and a front side of said luggage body is larger than the distance between the axis of said luggage wheels and the said front side of said luggage body.

2. The luggage as claimed in claim 1, wherein said support member of said support mechanism further comprises a slot located on said base block and disposed in communication with said pivot hole; said position-limiting member is accommodated in said slot and loaded with a spring member that imparts a pressure to said support mechanism toward said pivot hole.

3. The luggage as claimed in claim 1, wherein said luggage body comprises a back panel, a front panel, a bottom panel, a top panel and two opposing side panels connected to one another and a giving-away surface located on the junction between said bottom panel and said back panel and inwardly recessed toward the inside of said luggage body; said two luggage wheels are respectively mounted to said two opposing side panels and partially peripherally exposed to the outside of said giving-away surface of said luggage body.

4. The luggage as claimed in claim 1, wherein the angle defined between said first positioning groove of said locating shaft of said support mechanism and said stop rib is smaller than the angle defined between said second positioning groove and said stop rib.

* * * * *